US006491507B1

(12) United States Patent
Allen

(10) Patent No.: US 6,491,507 B1
(45) Date of Patent: Dec. 10, 2002

(54) APPARATUS FOR MELTBLOWING MULTI-COMPONENT LIQUID FILAMENTS

(75) Inventor: Martin A. Allen, Dawsonville, GA (US)

(73) Assignee: Nordson Corporation, Westlake, OH (US)

( * ) Notice: Subject to any disclaimer, the term of this patent is extended or adjusted under 35 U.S.C. 154(b) by 19 days.

(21) Appl. No.: 09/702,387

(22) Filed: Oct. 31, 2000

(51) Int. Cl.[7] ..... D01D 5/12; D01D 5/32

(52) U.S. Cl. ..... 425/7; 425/72.2; 425/131.5; 425/192 S; 425/463

(58) Field of Search ..... 425/7, 72.2, 131, 425/5, 192 S, 463; 264/172.11, 172.12, 172.13, 172.14, 172.15

(56) References Cited

U.S. PATENT DOCUMENTS

| | | | | |
|---|---|---|---|---|
| 3,981,650 A | * | 9/1976 | Page | 425/72.2 |
| 4,406,850 A | | 9/1983 | Hills | |
| 5,145,689 A | * | 9/1992 | Allen et al. | 425/72.2 |
| 5,162,074 A | | 11/1992 | Hills | |
| 5,344,297 A | | 9/1994 | Hills | 425/131.5 |
| 5,466,410 A | | 11/1995 | Hills | 264/172.11 |
| 5,511,960 A | * | 4/1996 | Terakawa et al. | 425/131.5 |
| 5,551,588 A | | 9/1996 | Hills | |
| 5,562,930 A | | 10/1996 | Hills | 425/198 |
| 5,580,581 A | * | 12/1996 | Buehning | 425/72.2 |
| 5,601,851 A | * | 2/1997 | Terakawa | 425/72.2 |
| 6,120,276 A | * | 9/2000 | Balk | 425/72.2 |

OTHER PUBLICATIONS

International Fiber Journal, Special Report on Biocomponent Fibers Acquisitions Shake Up Fiber Indsutry Show Reports: Fiber Producer Exhibition, IDEA 98, pp. 20–97, Jun. 1998.

* cited by examiner

*Primary Examiner*—Jan H. Silbaugh
*Assistant Examiner*—Joseph Leyson
(74) *Attorney, Agent, or Firm*—Wood, Herron & Evans, L.L.P.

(57) ABSTRACT

An apparatus for meltblowing multiple types of liquid materials into multi-component filaments. A pair of outer manifold elements sandwich an intermediate manifold element. Respective channels are formed between opposing sides of the outer manifold elements and the respective opposite sides of the intermediate manifold element. These recesses form channels which diverge or widen away from associated inlets at the top of the manifold assembly. A die tip is coupled to the manifold assembly at a lower side and communicates with the outlets of the channels. The die tip includes a combining member for producing a desired multi-component filament configuration and further includes air discharge passages for impinging the discharged multi-component filaments with pressurized air.

4 Claims, 2 Drawing Sheets

APPARATUS FOR MELTBLOWING MULTI-COMPONENT LIQUID FILAMENTS

This application relates to U.S. application Ser. No. 09/702,385, assigned to the assignee of the present invention and filed on even date herewith. The disclosure of this related application is fully incorporated herein by reference.

FIELD OF THE INVENTION

The present invention generally relates to meltblowing apparatus for dispensing thermoplastic filaments and, more particularly, apparatus for meltblowing multi-component filaments.

BACKGROUND OF THE INVENTION

Meltblowing technology is used in many different applications and industries including, for example, in adhesive dispensing and nonwoven material manufacturing. This technology generally involves extruding fine diameter filaments of thermoplastic material from a row of discharge outlets and impinging the extruded filaments with pressurized air immediately upon discharge. The pressurized air may be discharged as continuous sheets or curtains on opposite sides of the discharged filaments or as individual streams associated with the filament discharge outlets. The pressurized air is often referred to as process or primary air. This air draws down or attenuates the filament diameter while the filaments are airborne. The filaments are then randomly dispersed onto a substrate or a carrier.

For certain applications, it is desirable to utilize multiple types of thermoplastic liquid materials to form individual cross-sectional portions of each filament. Often, these multi-component filaments comprise two components and, therefore, are referred to as bicomponent filaments. For example, when manufacturing nonwoven materials for use in the garment industry, it may be desirable to produce bicomponent filaments having a sheath-core construction. The sheath may be formed from a softer material which is comfortable to the skin of an individual and the core may be formed from a stronger, but perhaps less comfortable material having greater tensile strength to provide durability to the garment. Another important consideration involves cost of the material. For example, a core of inexpensive material may be combined with a sheath of more expensive material. For example, the core may be formed from polypropylene or nylon and the sheath may be formed from a polyester or co-polyester. Many other multi-component fiber configurations exist, including side-by-side, tipped, and microdenier configurations, each having its own special applications. Various material properties can be controlled using one or more of the component liquids. These include, as examples, thermal, chemical, electrical, optical, fragrance, and anti-microbial properties. Likewise, many types of die tips exist for combining the multiple liquid components just prior to discharge to produce filaments of the desired cross-sectional configuration.

One problem associated with multi-component meltblowing apparatus involves the cost and complexity of the manifolds used to transmit each of the separate component liquids to the multi-component die tip. Typical manifolds must be machined with many different passages leading to the die tip to ensure that the proper flow of each component liquid reaches the die tip under the proper pressure and temperature conditions. These manifolds are therefore relatively complex and expensive components of the multi-component meltblowing apparatus.

For these reasons, it would be desirable to provide a meltblowing apparatus having a manifold system which may be easily manufactured and yet fulfils the requirement of effectively transmitting each of the component liquids to the multi-component die tip.

SUMMARY OF THE INVENTION

The present invention therefore provides an apparatus for meltblowing multiple types of liquid materials into multi-component filaments including a unique manifold structure coupled with a multicomponent die tip. In one general aspect, the apparatus comprises an intermediate manifold element having first and second opposite surfaces. First and second outer manifold elements respectively couple to the first and second opposite surfaces and have respective opposed surfaces. Each opposed surface respectively abuts one of the first and second opposite surfaces of the intermediate manifold elements. A first channel is formed between the opposed surface of the first outer manifold element and the first opposite surface of the intermediate manifold element. A second channel is formed between the opposed surface of the second outer manifold element and the second opposite surface of the intermediate manifold element. The first and second channels have inlets for respectively receiving the first and second liquids and outlets for respectively discharging the first and second liquids. These inlets and outlets may be formed in the intermediate manifold element, in the outer manifold elements, or between the intermediate manifold element and the respective outer manifold elements. The first and second channels may comprise recesses formed in the first and second opposite surfaces of the intermediate manifold element, or recesses formed in the opposed surfaces of the first and second outer manifold elements, or any combination thereof which forms the necessary channels.

A die tip is coupled adjacent the manifold elements and includes a plurality of multi-component filament discharge outlets. The die tip further includes at least first and second liquid distribution passages adapted to receive the first and second liquids respectively from the first and second channels. A liquid combining member communicates between the first and second liquid distribution passages and the filament discharge outlets. The liquid combining member receives the first and second liquids combines these liquids into respective multi-component filaments of a desired cross-sectional configuration just prior to discharge. Air discharge outlets are positioned adjacent the filament discharge outlets for supplying pressurized air to impinge the multi-component filaments upon discharge from the die tip.

In a more specific preferred embodiment of the manifold structure, the first and second outer manifold elements have respective recesses and, more preferably, a plurality of recesses on their respective opposed surface. The intermediate manifold element is coupled between the respective opposed surfaces of the first and second outer manifold elements. The recesses on the respective first and second opposite surfaces of the intermediate manifold element communicate, and preferably align with corresponding recesses on the opposed surfaces of the first and second outer manifold elements. The communicating recesses together form at least first and second channels and, preferably, first and second pluralities of channels each having a liquid inlet and a liquid outlet communicating with the die tip on the opposite sides of the intermediate manifold element.

Various advantages, objectives, and features of the invention will become more readily apparent to those of ordinary skill in the art upon review of the following detailed description of the preferred embodiments, taken in conjunction with the accompanying drawings.

DETAILED DESCRIPTION OF THE PREFERRED EMBODIMENTS

Figure 1:
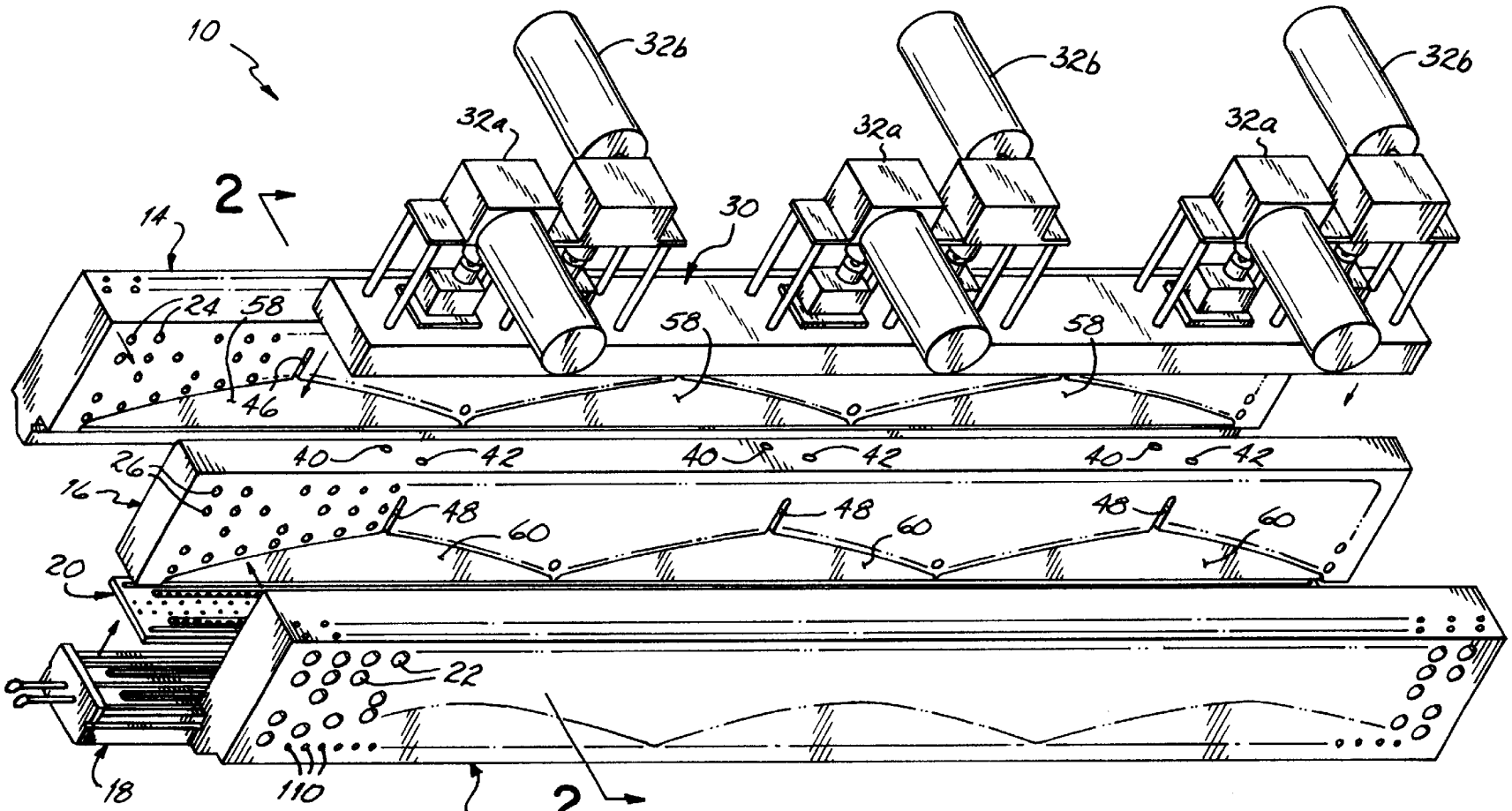
FIG. 1 is an exploded perspective view of a multi-component meltblowing apparatus constructed in accordance with the invention.
Figure 2:
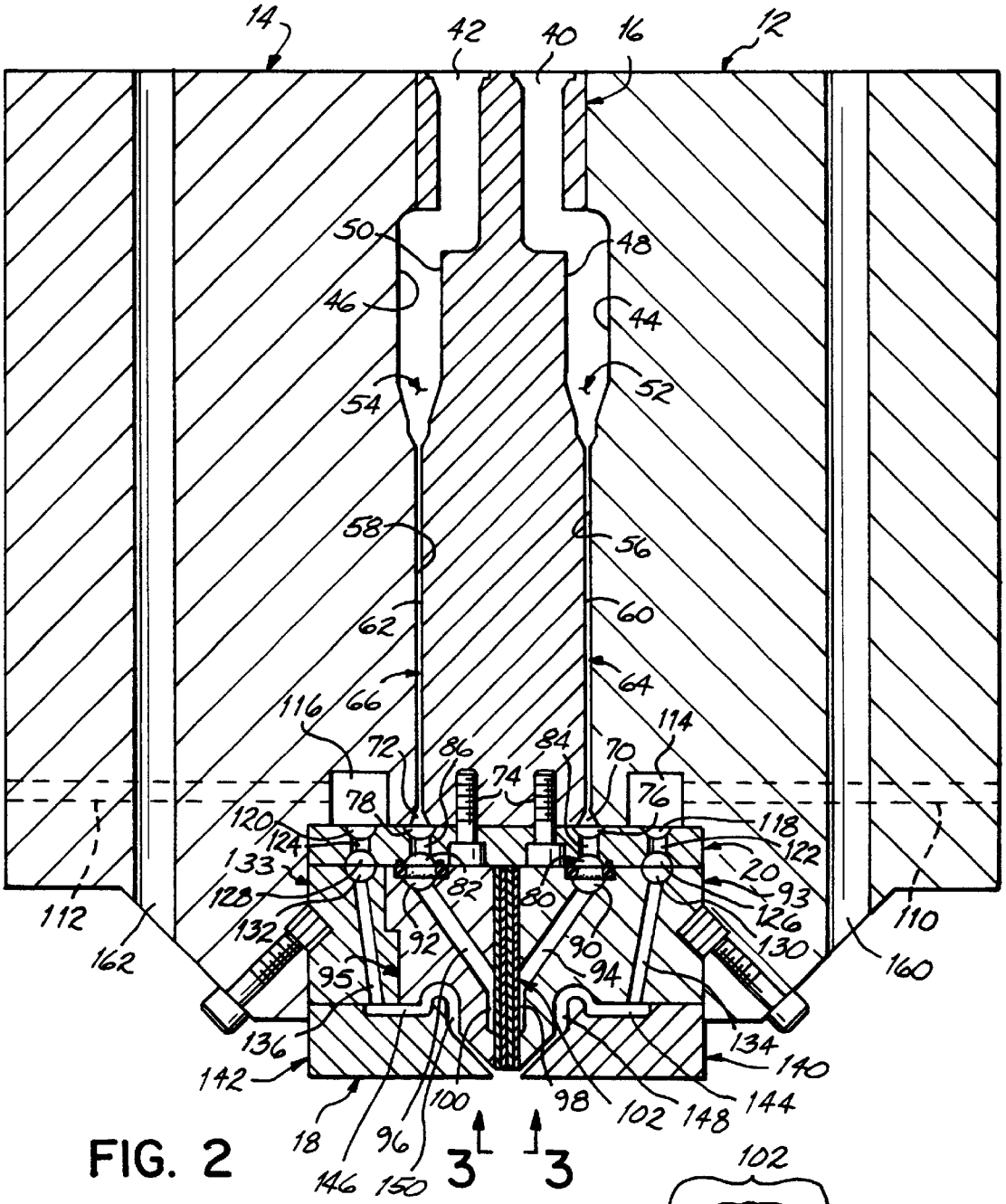
FIG. 2 is a cross section taken generally along line 2—2 of FIG. 1, but illustrating the apparatus in assembled condition.

Referring to FIGS. 1 and 2, a meltblowing apparatus 10 constructed in accordance with the inventive principles includes first and second outer manifold elements 12, 14. An intermediate manifold element 16 is coupled between outer manifold elements 12, 14 in sandwiching relation. A die tip 1 8, as well as a liquid and air distribution member 20 are coupled to outer manifold elements 12, 14 and intermediate manifold element 16. Threaded fasteners (not shown) are inserted through holes 22, 24 in the respective outer manifold elements 12, 14 and thread into internally threaded holes 26 contained in intermediate manifold element 16. Although only holes 26 are shown, it will be appreciated that the opposite side of manifold element 16 has similar threaded holes. A liquid supply block 30 is mounted to an upper surface of intermediate manifold element 16 and includes a plurality of pumps 32*a,* 32*b* for respectively pumping first and second types of liquid, such as thermoplastic material. The first type of liquid is pumped into each inlet 40 and the second type of liquid is pumped into each inlet 42 in the top of intermediate manifold element 16. Although three sets of pumps 32*a,* 32*b* are shown in this preferred embodiment, it will be understood that a greater or fewer number of pump sets 32*a,* 32*b* may be provided instead. Alternatively, other manners of supplying manifolds 12, 14, 16 with multiple types of liquids may be employed instead. In addition, the side-by-side manifold concepts of this invention may be employed to form filaments from more than two component liquids.

As shown best in FIG. 2, outer manifold elements 12, 14 include respective opposed notches 44, 46 communicating with liquid supply inlets 40, 42. Corresponding notches 48, 50 are formed in opposite side surfaces of intermediate manifold element 16 such that respective channels 52, 54 are formed for receiving the component liquids from inlets 40, 42. Recesses 56, 58 are formed in opposed sides of outer manifold elements 12, 14 and align with corresponding recesses 60, 62 formed on opposite sides of intermediate manifold element 16. These aligned recesses form respective channels 64, 66 which communicate at respective upper ends thereof with channels 52, 54 and which further include discharge outlets 70, 72 at lower ends thereof. It will be appreciated that channels 64, 66 may instead be formed by recesses formed only on intermediate manifold element 16 or only on outer manifold elements 12, 14 and, in that case, the abutting manifold element will serve as a cover plate. Discharge outlets 70, 72 abut liquid and air distribution member or plate 20 which is held to intermediate manifold element 16 by fasteners 74. As appreciated from FIG. 1, each channel 64, 66 formed respectively between recesses 56, 60 and recesses 58, 62 diverges or widens in a lengthwise direction relative to the lengthwise extents of manifold elements 12, 14, 16 from inlet channels 52, 54 to outlets 70, 72.

Figure 3:
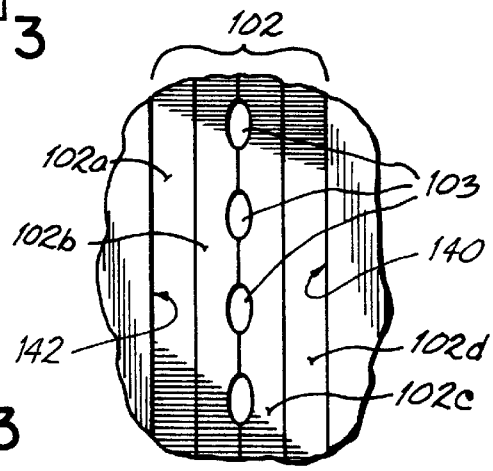
FIG. 3 is an enlarged view of the outlets of the invention as seen via line 3—3 of FIG. 2.

Liquid and air distribution member 20 includes lengthwise slots 76, 78 which respectively align and communicate with outlets 70, 72 for receiving the first and second component liquids. Slots 76, 78 further communicate with lengthwise slots 80, 82 formed on an opposite face of liquid and air distribution member through a plurality of vertically oriented passages 84, 86 extending lengthwise along member 20. Respective slots 90, 92 formed lengthwise along the upper surfaces of respective blocks 93, 95 transmit the first and second types of liquids respectively to a plurality of passages 94 and a plurality of passages 96 communicating with slots 98, 100 along the lengths of blocks 93, 95. Slots 98, 100 transfer the first and second liquids to a combining member 102 which may be formed from a plurality of vertically stacked plates 102*a,* 102*b,* 102*c,* 102*d* having an appropriate configuration to produce multi-component filaments from outlets 103 (see FIG. 3). In this example, the filaments produced are biocomponent filaments. Any number of different plate configurations may be used and may be formed through conventional etching techniques. The specific configuration of the plates and the configurations of slots, recesses and orifices in the plates will depend on the desired multi-component filament configuration, e.g., sheath-core, side-by-side, etc. As this conventional structure forms no part of the inventive concepts, the details are not provided herein.

Outer manifold elements 12, 14 further include a plurality of air supply passages 110, 112 for supplying pressurized process air to a pair of slots 114, 116 extending lengthwise along respective lower surfaces of outer manifold elements 12, 14. Slots 114, 116 respectively communicate with corresponding lengthwise slots 118, 120 formed in the upper surface of member 20. A plurality of vertically oriented passages 122, 124 transmit the pressurized air from slots 118, 120 to respective slots 126, 128 formed on an opposite, lower face of member 20. Slots 126, 128 communicate with corresponding, aligned slots 130, 132 formed respectively in block 93 and another block 133 held adjacent to block 95. Respective passages 134, 136 in blocks 93, 133 communicate the pressurized process air to respective air distribution plates 140, 142 having channels 144, 146 formed in respective upper surfaces thereof. These channels have discharge portions 148, 150 for directing the pressurized air as converging sheets directed generally toward the liquid filament discharge outlets of combining member 102. The sheets of air draw down or attenuate the discharged filaments prior to their deposition onto a substrate or carrier. Holes 160 or 162 located along the length of each outer manifold element 12, 14 receive heater rods for heating the two liquids and the process air to an appropriate application temperature. Temperature sensing devices (not shown), such as RTD's or thermocouples are also placed in manifold elements 12, 14 to control the temperature.

Although not shown in the drawings, suitable fasteners are used to affix air distribution plates 140, 142 to blocks 93, 95 and additional fasteners are used to affix block 133 to block 95. Although gaskets are only shown between slots 80, 90 and 82, 92, it will be appreciated that additional gaskets may be used between all components between which air or liquid transfer takes place to prevent undesirable leakage.

While the present invention has been illustrated by a description of various preferred embodiments and while these embodiments has been described in some detail, it is not the intention of the Applicant to restrict or in any way limit the scope of the appended claims to such detail. Additional advantages and modifications will readily appear to those skilled in the art. The various features of the invention may be used alone or in numerous combinations depending on the needs and preferences of the user. This has been a description of the present invention, along with the preferred methods of practicing the present invention as currently known. However, the invention itself should only be defined by the appended claims, wherein I claim:

What is claimed is:

1. An apparatus for meltblowing at least first and second liquid materials into multi-component filaments, comprising:

first and second outer manifold elements having respective opposed surfaces, each outer manifold element including a recess on its respective opposed surface, and an intermediate manifold element coupled between said respective opposed surfaces of said first and second outer manifold elements, said intermediate manifold element having first and second liquid supply inlets for receiving the first and second liquid materials, and having first and second outer manifold elements, said intermediate manifold element having first and second opposite surfaces each having a recess, said recesses on said first and second opposite surfaces respectively communicating with said recesses on said opposed surfaces to form first and second channels, said first and second channels in fluid communication with said first and second liquid supply inlets and having outlets for respectively discharging the first and second liquid materials, a die tip coupled to said outer manifold elements and said intermediate manifold element, said die tip including a plurality of multi-component filament discharge outlets, at least first and second liquid distribution passages adapted to receive the first and second liquid materials respectively from said outlets of said first and second channels, and a liquid combining member communicating between said first and second liquid distribution passages and said filament discharge outlets, said liquid combining member configured to receive the first and second liquid materials and combine the first and second liquid materials into respective multi-component filaments, and air discharge outlets positioned adjacent said filament discharge outlets for supplying pressurized air to impinge the multi-component filaments upon discharge from said die tip, and first and second pumps mounted to said intermediate manifold element, said first pump configured to supply the first liquid material to said first liquid supply inlet and said second pump configured to supply the second liquid material to said second liquid supply inlet.

2. The apparatus of claim 1, wherein said channels extend along lengthwise portions of said manifold elements and each channel widens along its associated lengthwise portion in a direction from its respective inlet toward its respective outlet.

3. The apparatus of claim 2, further comprising a plurality of said channels respectively formed by a plurality of said recesses on said opposite sides of said intermediate manifold element and on said opposing sides of said outer manifold elements.

4. The apparatus of claim 1, further comprising a plurality of said channels respectively formed by a plurality of said recesses on said opposite sides of said intermediate manifold element and on said opposing sides of said outer manifold elements.

* * * * *